US009429337B2

(12) United States Patent
Lannes et al.

(10) Patent No.: US 9,429,337 B2
(45) Date of Patent: Aug. 30, 2016

(54) WATER HEATER HAVING A DOWN FIRED COMBUSTION ASSEMBLY

(71) Applicant: Bradford White Corporation, Ambler, PA (US)

(72) Inventors: Eric M. Lannes, Caledonia, MI (US); Christopher P. Stafford, Hastings, MI (US)

(73) Assignee: BRADFORD WHITE CORPORATION, Ambler, PA (US)

( * ) Notice: Subject to any disclaimer, the term of this patent is extended or adjusted under 35 U.S.C. 154(b) by 0 days.

(21) Appl. No.: 14/091,879

(22) Filed: Nov. 27, 2013

(65) Prior Publication Data

US 2015/0144075 A1 May 28, 2015

(51) Int. Cl.

| | |
|---|---|
| ***F24H 8/00*** | (2006.01) |
| ***F24H 1/20*** | (2006.01) |
| ***F24H 1/28*** | (2006.01) |
| ***F24H 1/36*** | (2006.01) |
| ***F24H 1/44*** | (2006.01) |
| ***F24H 9/18*** | (2006.01) |

(52) U.S. Cl.
CPC ..... *F24H 1/205* (2013.01); *F24H 1/285* (2013.01); *F24H 1/36* (2013.01); *F24H 1/44* (2013.01); *F24H 9/1836* (2013.01)

(58) Field of Classification Search
CPC ..... F24H 1/206; F24H 1/287; F24H 8/00; F24H 9/0026; F23C 3/004; F23D 14/36
USPC ..... 122/13.01, 14.1, 14.2, 14.21, 14.22
See application file for complete search history.

(56) References Cited

U.S. PATENT DOCUMENTS

| | | | | |
|---|---|---|---|---|
| 4,170,963 A | | 10/1979 | Siegrist | |
| 5,197,415 A | * | 3/1993 | Stretch et al. | 122/14.22 |
| 5,531,214 A | * | 7/1996 | Cheek | 122/14.1 |

(Continued)

FOREIGN PATENT DOCUMENTS

| | | |
|---|---|---|
| CA | 1134220 | 10/1982 |
| DE | 1111794 | 7/1961 |
| GB | 965252 | 7/1964 |

OTHER PUBLICATIONS

International Search Report for International Application No. PCT/US2014/067594 mailed Feb. 11, 2015.

(Continued)

*Primary Examiner* — Gregory A Wilson
(74) *Attorney, Agent, or Firm* — RatnerPrestia

(57) ABSTRACT

Disclosed is a water heater that has a water storage tank, a first pass flue tube extending from a top of the water storage tank to a bottom of the water storage tank, a down-fired burner assembly positioned to direct combustion gases into the first pass flue tube, a plurality of second pass flue tubes extending from the bottom of the water storage tank to a top of the water storage tank, and an expansion chamber positioned below the bottom of the water storage tank. The expansion chamber receives the combustion gases from the first pass flue tube and delivers the combustion gases to the second pass flue tubes. The water heater operates with a non-positive vent static pressure and with a vent gas temperature that avoids or reduces excessive condensate production in an exhaust vent connected to receive combustion gases from the water heater.

16 Claims, 5 Drawing Sheets

(56) References Cited

U.S. PATENT DOCUMENTS

| | | | | |
|---|---|---|---|---|
| 5,699,756 | A * | 12/1997 | Ross et al. | 122/18.3 |
| 5,797,358 | A * | 8/1998 | Brandt et al. | 122/448.1 |
| 7,458,341 | B2 | 12/2008 | Lannes | |
| 7,559,293 | B2 * | 7/2009 | Gordon et al. | 122/13.01 |
| 7,900,588 | B2 * | 3/2011 | Zimmermann et al. | 122/14.21 |
| 2012/0291719 | A1 * | 11/2012 | Steinhafel | 122/18.3 |

OTHER PUBLICATIONS

Written Opinion of the International Searching Authority for International Application No. PCT/US2014/067594 mailed Feb. 11, 2015.

Notification, International Preliminary Report on Patentability and Written Opinion for International Application No. PCT/US2014/067594, dated Jun. 9, 2016, 8 pages.

* cited by examiner

WATER HEATER HAVING A DOWN FIRED COMBUSTION ASSEMBLY

FIELD OF THE INVENTION

This disclosure relates to water heaters configured to operate with a non-positive vent static pressure and with a vent gas temperature that avoids or reduces excessive condensate production in an exhaust vent connected to receive combustion gases from the water heater.

BACKGROUND OF THE INVENTION

Commercial and residential water heaters typically heat water by generating tens of thousands, and even hundreds of thousands, of BTUs. For many years, manufacturers of water heaters, and especially manufacturers of water heaters to be used in commercial applications, have sought to increase the efficiency of the exchange of this heat energy from burned fuel to the water contained in the water heater. Accordingly, maximized heat exchange efficiency has long been an object of commercial and residential water heater manufactures.

As heat exchange efficiency increases, however, such increased efficiency gives rise to the problems associated with condensation of water vapor from the products of combustion. More specifically, upon burning of a mixture of fuel and air, water is formed as a constituent of the products of combustion. It is recognized that as the temperatures of the combustion gases decrease as the result of successful exchange of heat from the combustion gases to water in the water heater, the water vapor within the combustion gases tends to be condensed in greater quantities. In other words, as the temperatures of the combustion gases decrease as a direct result of increasingly efficient exchange of heat energy to the circulated water, the amount of condensate forming on the heat exchange surfaces also increases. This condensate is typically found to increase when heat exchange efficiencies exceeding about 90% are achieved.

For example, U.S. Pat. No. 7,559,293 discloses a high efficiency water heater having a flue system designed to provide improved heat exchange efficiency. The flue system includes an upstream heat exchange portion having at least one substantially vertical flue tube. The flue system also includes a downstream heat exchange portion having at least one substantially vertical flue tube. The upstream heat exchange portion provides a first pass for heat exchange with water in a water heater. The downstream heat exchange portion provides a second pass for heat exchange with water in the water heater. Condensate may form in the heat exchange tubing (or flues) as the efficiency of heat exchange increases by virtue of the reduced temperature of the exhaust gases. In order to manage any such condensation, the water heater is optionally provided with a condensate drain or a condensate pump or other means for permitting the condensate to flow or be withdrawn from the water heater.

Commercial and residential water heaters can be designed to operate below the efficiencies at which increased quantities of condensate are likely to form (i.e., below the condensing mode). To do so, however, compromises the efficiency of the water heater. Accordingly, there continues to be a need for improved water heating systems having targeted heat exchange efficiency yet resisting the effects of water vapor condensation associated with such efficiency.

SUMMARY OF THE INVENTION

In accordance with an embodiment of the invention, a water heater operates with a non-positive vent static pressure and with a vent gas temperature that avoids or reduces excessive condensate production in an exhaust vent connected to receive combustion gases from the water heater. The water heater includes a water storage tank, a first pass flue tube extending from a top of the water storage tank to a bottom of the water storage tank, a down-fired burner assembly positioned to direct combustion gases into the first pass flue tube, one or more second pass flue tubes extending from the bottom of the water storage tank to a top of the water storage tank, and an expansion chamber positioned below the bottom of the water storage tank. The expansion chamber receives the combustion gases from the first pass flue tube and delivers the combustion gases to the second pass flue tube(s). An outer perimeter region of the expansion chamber generally corresponds to an outer perimeter of the water storage tank.

A combustion gas outlet positioned at or above the top of the water storage tank. The combustion gas outlet receives the combustion gases from the second pass flue tube(s) and delivers the combustion gases toward the vent with the non-positive vent static pressure. The expansion chamber promotes heat transfer between the combustion gases in the expansion chamber and water in the water storage tank through a bottom surface of the water storage tank.

Also disclosed is a method of producing a water heater that is configured to operate with a non-positive vent static pressure and with a vent gas temperature that avoids or reduces excessive condensate production in an exhaust vent connected to receive combustion gases from the water heater. The method includes the steps of extending a first pass flue tube from a top of a water storage tank to a bottom of the water storage tank, positioning a down-fired burner assembly to direct combustion gases into the first pass flue tube, extending one or more second pass flue tubes from the bottom of the water storage tank to a top of the water storage tank, positioning an expansion chamber below the bottom of the water storage tank, and positioning a combustion gas outlet above the top of the water storage tank, the combustion gas outlet being coupled to receive the combustion gases from the second pass flue tube(s) and to deliver the combustion gases toward the vent with the non-positive vent'static pressure.

DETAILED DESCRIPTION OF THE INVENTION

Figure 1A:
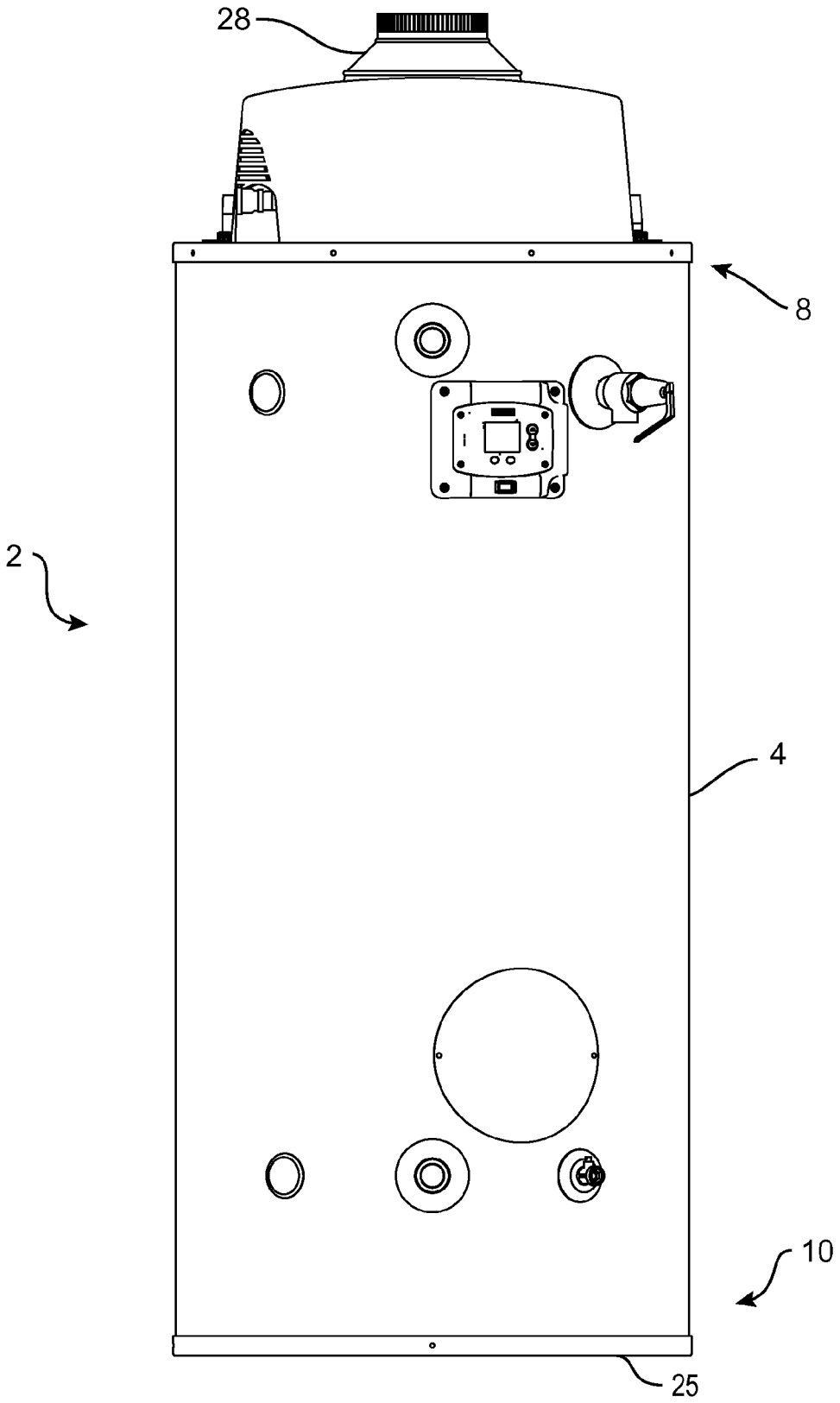
FIG. 1A shows a front view of an embodiment of a water heater according to aspects of this invention.

A detailed description of embodiments of the invention follows. Although the invention is illustrated and described herein with reference to specific embodiments, the invention is not intended to be limited to the details shown. Rather, various modifications may be made in the details within the scope and range of equivalents of the claims and without departing from the invention.

Some models of water heaters for residential and commercial use include a storage tank of water. Combustion gas for such storage water heaters is often introduced on a bottom side of the water heater. This invention, however, contemplates the introduction of combustion gas on a bottom side or top side of the water heater with respect to the water storage tank.

Referring generally to the figures, this invention provides a water heater such as water heater 2 that operates with a non-positive vent static pressure and with a vent gas temperature that avoids or reduces excessive condensate production in an exhaust vent, such as exhaust vent 46, that is connected to receive combustion gases from the water heater. The water heater includes a water storage tank such as tank 4, a first pass flue tube such as tube 6 extending from a top (e.g., item 8) of the water storage tank to a bottom (e.g., item 10) of the water storage tank, a down-fired burner assembly (e.g., item 12) positioned to direct combustion gases into the first pass flue tube, one or more second pass flue tubes such as tubes 14 extending from the bottom of the water storage tank to a top of the water storage tank, and an expansion chamber (e.g., item 16) positioned below the bottom of the water storage tank. The expansion chamber receives the combustion gases from the first pass flue tube and delivers the combustion gases to the second pass flue tube(s). An outer perimeter region of the expansion chamber generally corresponds to an outer perimeter 20 of the water storage tank.

In the illustrated embodiments, a combustion gas outlet 22 is positioned at or above the top 8 of the water storage tank 4. The combustion gas outlet 22 receives the combustion gases from the second pass flue tube(s) 14 and delivers the combustion gases toward the vent 46 with the non-positive vent static pressure. The expansion chamber 16 promotes heat transfer between the combustion gases in the expansion chamber 16 and water in the water storage tank 4 through a bottom surface 10 of the water storage tank 4.

Also disclosed is a method of producing the water heater 2 that is configured to operate with a non-positive vent static pressure and with a vent gas temperature that avoids or reduces excessive condensate production in the exhaust vent 46 connected to receive combustion gases from the water heater 2. The method includes the steps of extending the first pass flue tube 6 from a top 8 of a water storage tank 4 to a bottom 10 of the water storage tank 4, positioning a down-fired burner assembly 12 to direct combustion gases into the first pass flue tube 6, extending one or more second pass flue tubes 14 from the bottom 10 of the water storage tank 4 to a top 8 of the water storage tank 4, positioning an expansion chamber 16 below the bottom 10 of the water storage tank 4, and positioning a combustion gas outlet 22 above the top 8 of the water storage tank 4, the combustion gas outlet 22 being coupled to receive the combustion gases from the second pass flue tube(s) 14 and to deliver the combustion gases toward the vent 46 with the non-positive vent static pressure.

Figure 1B:
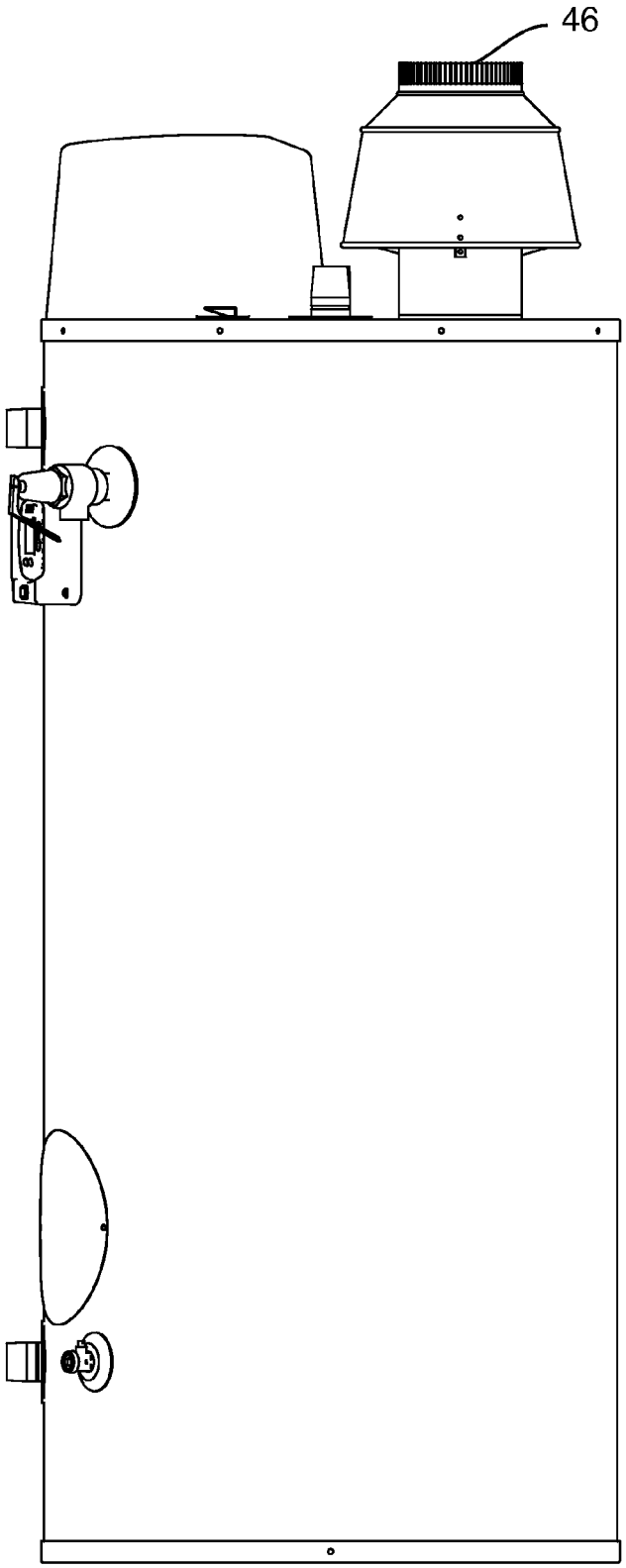
FIG. 1B shows a side view of the water heater of FIG. 1.
Figure 2:
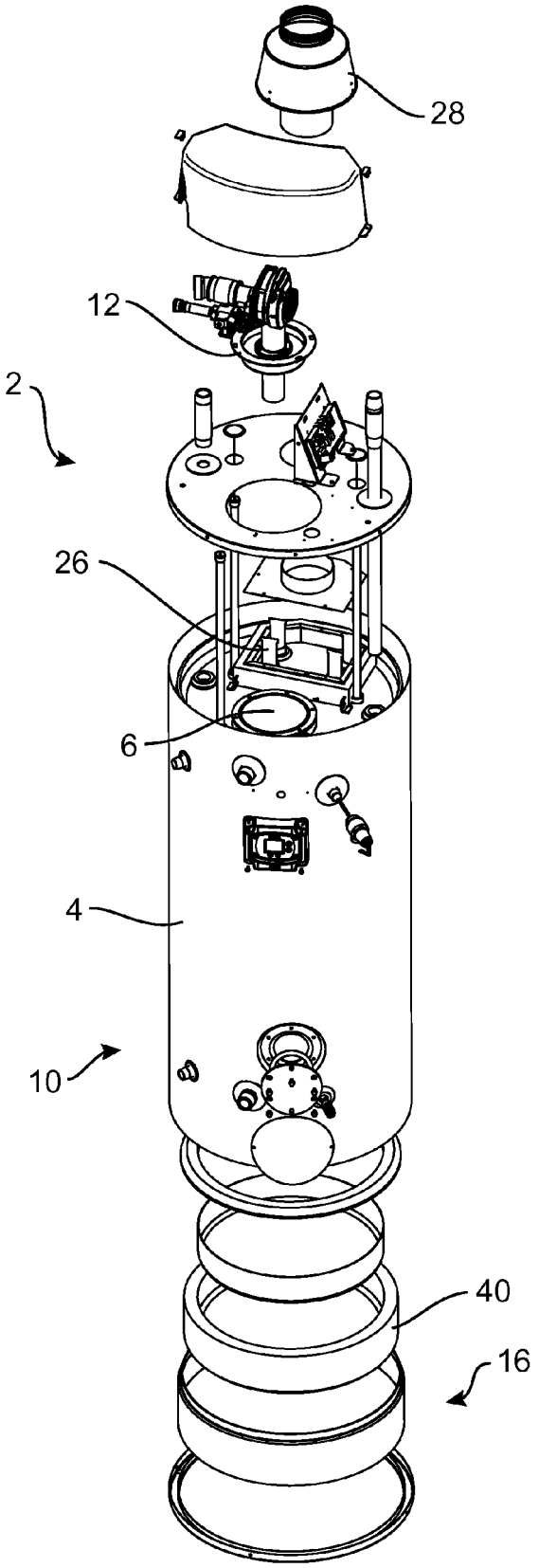
FIG. 2 shows an exploded view of the water heater of FIG. 1.
Figure 3:
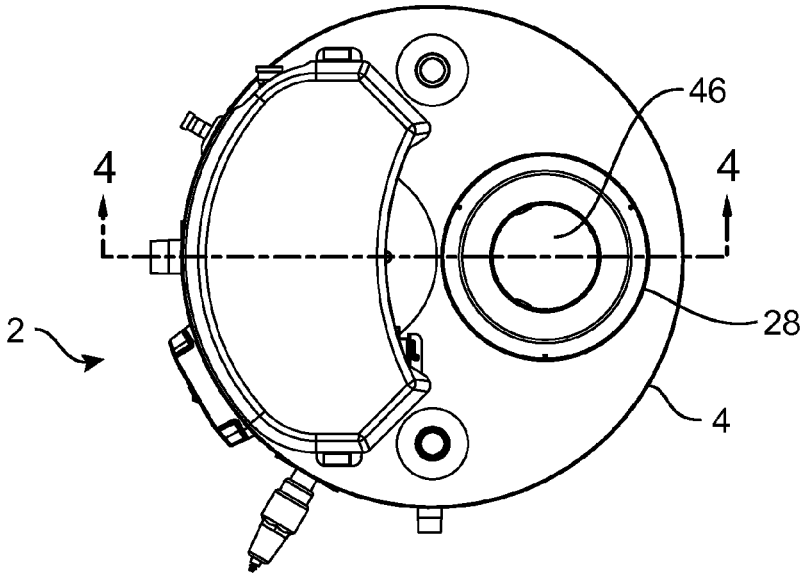
FIG. 3 is a top view of the water heater of FIG. 1.
Figure 4:
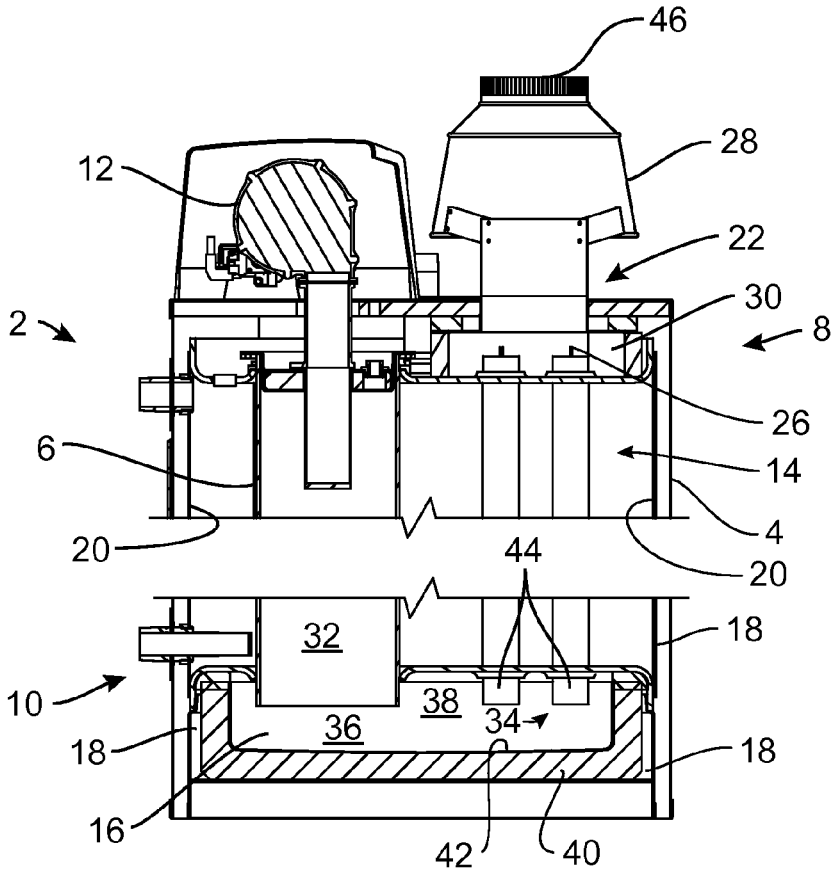
FIG. 4 shows a down fired burner assembly coupled to a flue inside the water heater of FIG. 1.
Figure 5:
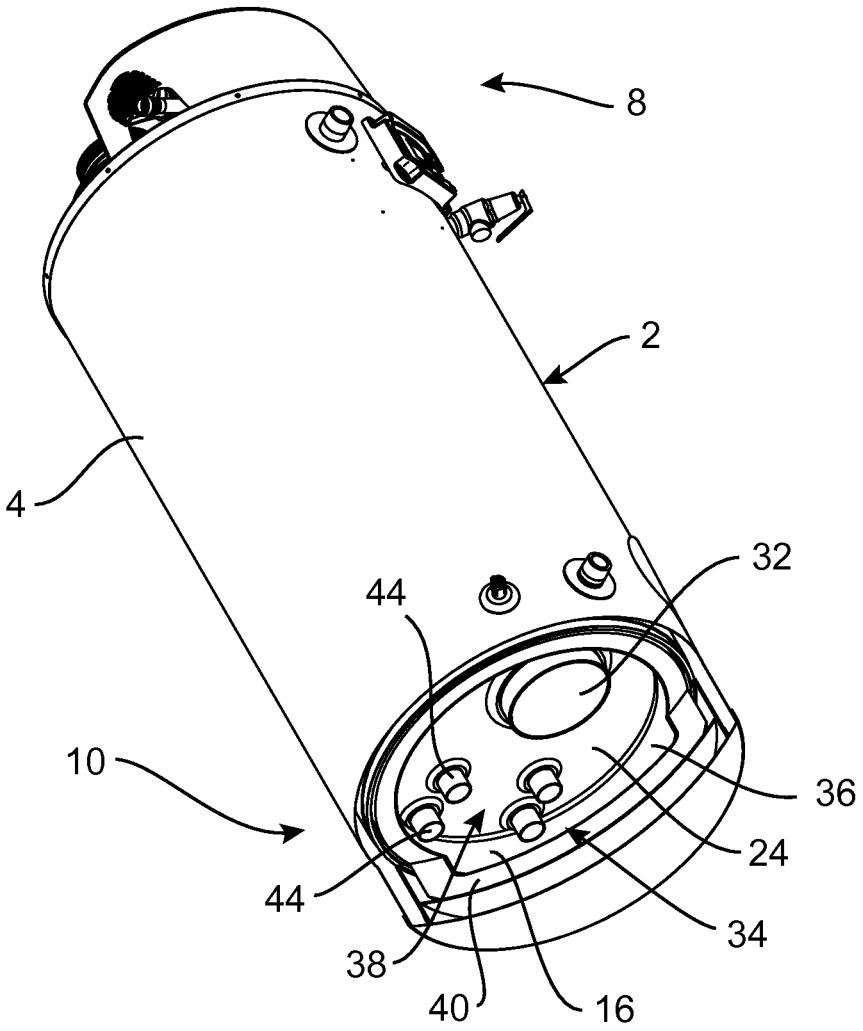
FIG. 5 shows a bottom view of the water heater of FIG. 1 and a cut-away view of an expansion chamber connected to a bottom side of the water heater.

FIGS. 1A and 1B show an embodiment of an inventive water heater 2 having a water storage tank 4. A down fired burner assembly 12 is positioned at a top region 8 of the water heater 2. The down fired burner assembly 12 is coupled to a first pass flue tube 6 (FIG. 3). The first pass flue tube 6 extends from the top region 8 of the water heater 2 to a bottom region 10 of the water heater 2. A plurality of second pass flue tubes 14 also extend from the top region 8 of the water heater 2 to the bottom region 10 of the water heater. The water heater 2 has an outer jacket including a jacket base 25.

The combustion system and exhaust vent is located on the top of the water heater that is atmospherically vented. The water heater's 2 combustion system uses a negative regulation pre-mix combustion system that mixes gas and air thoroughly before entering the burner assembly located in the primary heat exchanger. In using this style of combustion system there is the ability to have finite control of the air/gas ratios allowing for better mixing of the components of combustion, which in turn results in ultra-low NOx emissions levels. In other words, this produces ultra-low NOx emission levels with a high level of combustion efficiency and transfers heat directly into the water backed heat exchanger. The pre-mix combustion system fires into a large diameter firing tube under positive pressure allowing the products of combustion to pass through the heat exchanger.

The burner assembly location in the primary heat exchanger will eliminate any convective heat loss during the off cycle improving the overall efficiency. In other words, the burner assembly blocks the flow of heat attempting to escape upwardly and out of the primary heat exchanger, thus reducing standby losses. The heater exchanger transfers the thermal energy from the products of combustion into the water first down through the large diameter primary firing tube then back up through one or more smaller diameter secondary tubes in this two pass water heater design. The products of combustion are then collected at the top of the unit in an exhaust collector and vent atmospherically under non-positive or negative pressure through exhaust venting to a draft hood "diverter". The draft diverter is then connected to a properly sized atmospherically exhaust vent to move the products of combustion safely to the outside environment.

The disclosed water heater 2 uses a combustion system, two heat exchangers and a collection transfer system. Applying these items in a unique application for heating liquids creates substantially reduced emissions, increased operating efficiencies and decreases heat loss during off (non-operating) cycles. The end result is a smaller unit than current products in the market providing easy replacement and reducing the area required for new construction.

The water heater 2 optimizes the ultra-clean products of combustion for maximum heat transfer to water. This is accomplished by using two heat exchangers, the first pass flue tube 6 and the plurality of second pass flue tubes 14, respectively, with a unique collection and transfer method between the two heat exchanges. The first, pass flue tube 6 is the primary heat exchanger and is a single large diameter firing tube primarily contained within the water. A large diameter for the tube optimizes the clean products of combustion and maximizes heat transfer opportunities for varying energy input levels.

Thus, the water heater 2 is a two-pass system with combustion gas entering the water heater 2 at the top portion 8 of the water storage tank 4 and flows down to the bottom portion 10 of the water storage tank 4. The combustion gas is redirected back up into the water heater 2 through the plurality of second pass flue tubes 14. The plurality of second pass flue tubes 14 extend from the bottom 10 the water storage tank 4 to a top 8 of the water storage tank 4. The combustion gas then passes out of the water heater 2 through the combustion gas outlet 22.

The down-fired burner assembly 12 is positioned to direct combustion gases into the first pass flue tube 6. The negative regulation pre-mix system mixes the air/gas mixture at the face of a venturi and then again in the blower assembly before it enters the burner. The complete mixing of the gas/air mixture with more excess air than traditional style systems helps provide cleaner combustion The first pass flue tube 6 receives forced air from the down-fired burner assembly 12. The first pass flue tube 6 is in direct contact with fluid in the water tank 4.

An expansion chamber 16 is connected to the bottom 10 of the water storage tank 4. The expansion chamber 16 receives the combustion gases from the first pass flue tube 6 and delivers the combustion gases to the plurality of second pass flue tubes 14. An outer perimeter region 18 of the expansion chamber 16 generally corresponds to an outer perimeter 20 of the water storage tank 4. The exterior diameter of the expansion chamber 16 is equal or almost equal to an inner diameter of the water storage tank 4. The convex design of the stainless liner can of course have other shapes. For example, it may be convex, concave, flat or any other known shape.

The water heater 2 operates with a non-positive vent static pressure and with a vent gas temperature that avoids or reduces excessive condensate production in the exhaust vent 46 connected to receive combustion gases from the water heater. A combustion gas outlet 22 is positioned at or above the top portion 8 of the water storage tank 4. The combustion gas outlet 22 is coupled to a draft hood and receives the combustion gases from the second pass flue tubes 14 with the non-positive vent static pressure.

Baffles 26 are positioned within the second pass flue tubes 14. A draft hood 28 is coupled to the second pass flue tubes 14, receives combustion gases from the second pass flue tubes 14 and delivers combustion gases to the combustion gas outlet 22. The water heater is configured to exhaust combustion gases to the combustion gas outlet 22 without a damper. A collector 30 is positioned at or above the top of the water storage tank and collects combustion gases from the second pass flue tubes.

The expansion chamber 16 is configured to promote heat transfer between the combustion gases in the expansion chamber 16 and water in the water storage tank 4 through a bottom surface 24 of the water storage tank 4. A bottom end 32 of the first pass flue tube 6 and bottom ends 34 of the second pass flue tubes 14 extend into an interior 36 of the expansion chamber 16. A heat-retaining region 38 is defined by the expansion chamber 16 to further promote heat transfer between the combustion gases in the expansion chamber 16 and water in the water storage tank 4 through the bottom surface 24 of the water storage tank 4. By extending the first pass flue tube 6 and the second pass flue tubes 14 into the expansion chamber 16, warmer combustion gas is forced to hover at an upper portion of the interior 36 of the expansion chamber 16, i.e., the heat retaining region 38. As the combustion gas cools, it lowers and is forced into inlets 44 of the second pass flue tubes by combustion gas entering the interior 36 from the first pass flue tube 6. In other words, as the combustion gas cools by transferring heat to the water storage tank 4 through the bottom surface 24, it is forced into the inlets 44 of the second pass flue tubes 14. Thus, a direct fluid flow current from the bottom end 32 of the first pass flue tube 6 to the bottom end of the plurality of second pass flue tubes 14 is substantially avoided. Combustion gas is essentially delayed at the heat retaining region until it cools enough to lower to the level of the plurality of second pass flue tube inlets 44. The number of second pass flue tubes 14 (ranging anywhere from a single tube to sixteen or even more tubes) can be adjusted accordingly.

More specifically, combustion gas is preferably contained in the heat retaining region 38 until it cools enough to enter the second pass flue tubes 14 via tube inlets 44, which acts as a relief point. The optimum length of the primary tubes 6 and secondary tubes 14 extending into the interior 36 of the expansion chamber 16 can vary from ¼" or less to within ¼" or less of the surface 42 dependent on the energy input, heat transfer required through the bottom surface 24, or desired emission levels.

Therefore, once the temperatures of the combustion gases are reduced to a level ideal for transfer to the second heat exchanger a unique collection and redirection system is employed. The water heater 2 collects any potential condensate and efficiently redirects the products of combustion to the secondary heat exchanger (the second pass flue tubes 14). The products of combustion scrub the expansion chamber's 16 bottom during transition to maximize efficiency and provide for stratification reduction during the heating process. This unique collector system forces the products of combustion to ultimately change direction (180 degrees) to enter the secondary heat exchanger. The size of the expansion chamber 16 enables heat transfer from the combustion gases to water in the water storage tank 4 and vents the combustion gases with the non-positive vent static pressure, while maintaining at least eighty-two percent efficiency of the water heater.

Insulation 40 lines a substantial amount of the interior 36 of the expansion chamber 16. The insulation 40 is on all interior surfaces of the expansion chamber 16 except the side of the expansion chamber that is in contact with the bottom surface 24 of the water tank 4.

The lower surface of the expansion chamber 16 has a concave surface 42 in this embodiment but may also have a convex or flat or otherwise configured surface. The concave surface 42 is positioned downstream of the bottom end of the first pass flue tube 32 and redirects combustion gases received from the first pass flue tube toward bottom ends 34 of the second pass flue tubes 14.

The plurality of second pass flue tubes 14 effectively serve as a secondary heat exchanger that is composed of at least two smaller diameter tubes than the primary heat exchanger. Applying smaller diameter tubes enables the reduced temperature products of combustion to have an efficient path for maximizing the heat transfer to the liquid. Multiple tubes are used to reduce off cycle heat loss and flue baffles may be incorporated to provide a wider range of input to the system while maximizing combustion efficiency and decreased off cycle heat losses. Temperature of the combustion gas when it is traversing the second pass flue tubes is lower than the temperature of the combustion gas when it is traversing the first pass flue tube. Therefore, the added heat transfer surface area, which follows from the increased number of smaller tubes, results in efficaciously capturing heat from the lower temperature combustion gas in the second pass tubes. No more than about sixteen second pass flue tubes are necessary to capture heat from the combustion gas within the second pass flue tubes.

Alternatively, it is contemplated that the secondary heat exchanger is optionally composed of only a single tube as opposed to multiple tubes 14. In other words, the water heater optionally includes a first pass flue tube extending from a top of the water storage tank to a bottom of the water storage tank and a single second pass flue tube extending from the bottom of the water storage tank to the top of the water storage tank. If a single second pass flue tube is used, a baffle, other structure, and/or a modified flue tube is optionally used in the second pass flue tube to optimize heat transfer. For example, a convoluted flue tube structure can be used such as those disclosed in U.S. Pat. No. 7,458,341, the disclosure of which is incorporated by reference into this description in its entirety for all purposes. Similarly, a structure and/or modified flue tube is optionally used in the first pass flue tube to optimize heat transfer.

Accordingly, any number of second pass flue tubes ranging from a single tube to sixteen or even more tubes can be employed and the heat transfer characteristics of the second pass flue tube(s) can be optimized using baffles or other structures. Similarly, it is contemplated at multiple first pass flue tubes are optionally used. Reference to a first pass flue tube therefore encompasses one first pass flue tube and plural first pass flue tubes.

The presently disclosed water heater is effectively a Category I water heater, which operates with a non-positive vent static pressure and with a vent gas temperature that avoids excessive condensate production in the vent. Combining all of these benefits eliminates the need for a flue damper on the outlet of the appliance. The unique location of the burner in the primary heat exchanger and multiple flue tubes for the secondary heat exchanger breaks the convective heat loss path and retains the heat in the storage tank. The reduced heat loss decreases the amount of time the appliance has to operate to maintain the liquid temperature and extends the life expectancy.

Also disclosed is a method of producing a water heater configured to operate with a non-positive vent static pressure and with a vent gas temperature that avoids or reduces excessive condensate production in an exhaust vent 46 connected to receive combustion gases from the water heater. The method includes the steps of extending a first pass flue tube from a top of a water storage tank to a bottom of the water storage tank, positioning a down-fired burner assembly to direct combustion gases into the first pass flue tube, extending a plurality of second pass flue tubes from the bottom of the water storage tank to a top of the water storage tank, positioning an expansion chamber below the bottom of the water storage tank, and positioning a combustion gas outlet above the top of the water storage tank, the combustion gas outlet being coupled to receive the combustion gases from the second pass flue tubes and to deliver the combustion gases toward the vent 46 with the non-positive vent static pressure.

A thermal switch is mounted to a bracket, which is in turn mounted to the draft diverter. The thermal switch is located at the draft diverter's relief opening. If a blockage should occur in the exhaust venting above the draft diverter, then the thermal switch would open. When the thermal switch opens, this gives feedback to the water heater control that an unsafe condition is present and to take appropriate action.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

KEY TO REFERENCE NUMBERS

2 water heater
4 water storage tank
6 first pass flue tube
8 top of the water storage tank
10 bottom of the water storage tank
12 down-fired burner assembly
14 plurality of second pass flue tubes
16 expansion chamber
18 outer perimeter region of the expansion chamber
20 outer perimeter of the water storage tank
22 combustion gas outlet
24 bottom surface of the water storage tank.
26 baffles positioned within second pass flue tubes.
28 draft hood
30 collector
32 bottom end of the first pass flue tube
34 bottom ends of the second pass flue tubes
36 an interior of the expansion chamber
38 heat-retaining region of the expansion chamber
40 insulation substantially surrounding the expansion chamber
42 concave surface
44 inlets of the second pass flue tubes
46 vent

What is claimed:

1. A water heater configured to operate with a non-positive vent static pressure and with a vent gas temperature that avoids or reduces excessive condensate production in an exhaust vent connected to receive combustion gases from the water heater, the water heater comprising:

a water storage tank;

a first pass flue tube extending from a top of the water storage tank to a bottom of the water storage tank;

a down-fired burner assembly positioned to direct combustion gases into the first pass flue tube;

at least one second pass flue tube extending from the bottom of the water storage tank to the top of the water storage tank;

an expansion chamber positioned below the bottom of the water storage tank, the expansion chamber being coupled to receive the combustion gases from the first pass flue tube and to deliver the combustion gases to the at least one second pass flue tube, wherein a bottom end of the first pass flue tube and a bottom end of the at least one second pass flue tube extend through the bottom of the water storage tank into an interior of the expansion chamber, thereby defining a heat-retaining region of the expansion chamber extending from an elevation of the bottom end of the second pass flue tubes to the bottom of the water storage tank;

wherein an outer perimeter region of the expansion chamber corresponds to an outer perimeter of the water storage tank, such that the heat-retaining region of the expansion chamber is configured to promote heat transfer between the combustion gases in the expansion chamber and water in the water storage tank through the bottom surface of the water storage tank and to delay combustion gases in the heat-retaining region of the expansion chamber, thus promoting the heat transfer between the combustion gases in the heat-retaining region and the water in the water storage tank; and a combustion gas outlet positioned at or above the top of the water storage tank, the combustion gas outlet being coupled to receive the combustion gases from the at least one second pass flue tube and to deliver the combustion gases toward the vent with the non-positive vent static pressure.

2. The water heater as recited in claim 1, further comprising baffles positioned within the at least one second pass flue tube.

3. The water heater as recited in claim 1, the water heater being configured to exhaust combustion gases to the exhaust vent without a damper.

4. The water heater as recited in claim 1, further comprising a collector positioned at or above the top of the water storage tank and configured to collect combustion gases from the at least one second pass flue tube.

5. The water heater as recited in claim 1, further comprising insulation substantially surrounding the expansion chamber.

6. The water heater as recited in claim 1, the expansion chamber comprising a concave surface located downstream of an outlet of the first pass flue tube, the concave surface being shaped for redirecting combustion gases received from the outlet of the first pass flue tube toward an inlet of the at least one second pass flue tube.

7. The water heater as recited in claim 1, comprising plural second pass flue tubes but no more than sixteen second pass flue tubes.

8. The water heater as recited in claim 7, comprising no more than four second pass flue tubes.

9. The water heater as recited in claim 1, wherein the water heater vents the combustion gases with non-positive vent static pressure, while maintaining at least eighty-two percent efficiency.

10. The water heater as recited in claim 1, further comprising a draft hood directly coupled to the at least one second pass flue tube and configured to receive combustion gases from the at least one second pass flue tube and to deliver combustion gases to the exhaust vent.

11. The water heater as recited in claim 1, wherein the heat-retaining region has a size that results in an efficiency of 82% or more for the water heater and a non-positive vent static pressure.

12. The water heater as recited in claim 1, wherein the outer perimeter region of the expansion chamber has an exterior diameter that extends outwardly to equal an inner diameter of the water storage tank.

13. The water heater as recited in claim 1, wherein the bottom of the first pass flue tube extends to the elevation of the bottom of the at least one second pass flue tubes.

14. A water heater configured to operate with a non-positive vent static pressure and with a vent gas temperature that avoids or reduces excessive condensate production in an exhaust vent connected to receive combustion gases from the water heater, the water heater comprising:

a water storage tank;

a first pass flue tube extending from a top of the water storage tank to a bottom of the water storage tank;

a down-fired burner assembly positioned to direct combustion gases into the first pass flue tube;

at least one second pass flue tube extending from the bottom of the water storage tank to the top of the water storage tank;

an expansion chamber positioned below the bottom of the water storage tank, the expansion chamber being coupled to receive the combustion gases from the first pass flue tube and to deliver the combustion gases to the at least one second pass flue tube;

a combustion gas outlet positioned at or above the top of the water storage tank, the combustion gas outlet being coupled to receive the combustion gases from the at least one second pass flue tube and to deliver the combustion gases toward the vent with the non-positive vent static pressure; and a draft hood coupled to receive combustion gases directly from the at least one second pass flue tube and to deliver combustion gases to the exhaust vent.

15. The water heater as recited in claim 14, wherein the expansion chamber is configured to promote heat transfer between the combustion gases in the expansion chamber and water in the water storage tank through a bottom surface of the water storage tank.

16. A method of producing a water heater configured to operate with a non-positive vent static pressure and with a vent gas temperature that avoids or reduces excessive condensate production in an exhaust vent connected to receive combustion gases from the water heater, the method comprising:

extending a first pass flue tube from a top of a water storage tank to a bottom of the water storage tank;

positioning a down-fired burner assembly to direct combustion gases into the first pass flue tube;

extending at least one second pass flue tube from the bottom of the water storage tank to a top of the water storage tank;

extending a bottom end of the first pass flue tube and a bottom end of the at least one second pass flue tube into an interior of the expansion chamber thereby defining a heat-retaining region of the expansion chamber to further promote the heat transfer between the combustion gases in the expansion chamber and water in the water storage tank through the bottom surface of the water storage tank;

positioning an expansion chamber below the bottom of the water storage tank, the expansion chamber being coupled to receive the combustion gases from the first pass flue tube and to deliver the combustion gases to the at least one second pass flue tube, wherein an outer perimeter region of the expansion chamber corresponds to an outer perimeter of the water storage tank, thereby configuring the heat retaining region to delay combustion gasses therein;

the expansion chamber being sized to enable heat transfer from the combustion gases to water in the water storage tank and venting of the combustion gases with the non-positive vent static pressure, while maintaining at least eighty-two percent efficiency of the water heater; and positioning a combustion gas outlet above the top of the water storage tank, the combustion gas outlet being coupled to receive the combustion gases from the at least one second pass flue tube and to deliver the combustion gases toward the vent with the non-positive vent static pressure.

* * * * *